US010612296B2

(12) United States Patent
Frantz et al.

(10) Patent No.: US 10,612,296 B2
(45) **Date of Patent: *Apr. 7, 2020**

(54) APPLIANCE DOOR ASSEMBLY

(71) Applicant: WHIRLPOOL CORPORATION, Benton Harbor, MI (US)

(72) Inventors: William Frantz, Berrien Springs, MI (US); Timothy E. Heater, Hartford, MI (US); Ndjeka K. Luhahi, Grand Rapids, MI (US); Nicholas E. Mawhorr, Granger, IN (US); Jose Aldo Ramirez, Monterrey (MX); Scott T. Thalls, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/375,211

(22) Filed: Apr. 4, 2019

(65) Prior Publication Data

US 2019/0226272 A1 Jul. 25, 2019

Related U.S. Application Data

(63) Continuation of application No. 15/350,683, filed on Nov. 14, 2016, now Pat. No. 10,294,712.

(51) Int. Cl.
*E06B 5/00* (2006.01)
*E05D 3/08* (2006.01)
(Continued)

(52) U.S. Cl.
CPC ..... *E06B 5/00* (2013.01); *D06F 39/14* (2013.01); *E05D 3/08* (2013.01); *E05D 11/0081* (2013.01);
(Continued)

(58) Field of Classification Search
CPC ... D06F 39/14; E05B 5/00; E05D 3/00; E05D 11/0081
See application file for complete search history.

(56) References Cited

U.S. PATENT DOCUMENTS 3,883,201 A 5/1975 Busoni
5,278,725 A * 1/1994 Konno ..... G06F 1/1616 16/223
(Continued)

FOREIGN PATENT DOCUMENTS

CN 105420996 A 3/2016
CN 105442278 A 3/2016
(Continued)

OTHER PUBLICATIONS

European Search Report for Counterpart EP17197661.6, dated Feb. 28, 2018.

*Primary Examiner* — Daniel J Rohrhoff
(74) *Attorney, Agent, or Firm* — McGarry Bair PC

(57) ABSTRACT

A laundry appliance door assembly with a wire cover to protect the wire conductor that passes through the door hinge where it has a tendency to get pulled and damaged when the door is in motion. The wire cover includes a wire cover and a wire conduit coaxially connected together allowing the wire cover to rotate relative to the wiring conduit while within alignment of the hinge rotational axis. The wire cover comprises two lateral halves for ease of installation where it is designed to encase the wire conductor that passes through the door hinge.

20 Claims, 8 Drawing Sheets

(51) Int. Cl.

| | |
|---|---|
| ***E05D 11/00*** | (2006.01) |
| ***D06F 39/14*** | (2006.01) |
| ***D06F 58/20*** | (2006.01) |

(52) U.S. Cl.
CPC ..... *D06F 58/20* (2013.01); *E05Y 2900/30* (2013.01); *E05Y 2900/312* (2013.01)

(56) References Cited

U.S. PATENT DOCUMENTS

| | | | | |
|---|---|---|---|---|
| 7,137,173 | B2 | 11/2006 | Sipple | |
| 10,294,712 | B2 * | 5/2019 | Frantz | E05D 3/08 |
| 2004/0206106 | A1 * | 10/2004 | Lee | F25D 23/126 62/389 |
| 2006/0017361 | A1 * | 1/2006 | Rendel | E05D 11/0081 312/405 |
| 2007/0130730 | A1 | 6/2007 | Cho et al. | |
| 2015/0123523 | A1 * | 5/2015 | Woo | D06F 39/14 312/228 |
| 2016/0194802 | A1 * | 7/2016 | Heo | D06F 37/28 174/541 |
| 2018/0038040 | A1 * | 2/2018 | Kim | D06F 39/14 |
| 2018/0216381 | A1 * | 8/2018 | Lee | D06F 39/14 |

FOREIGN PATENT DOCUMENTS

| | | | |
|---|---|---|---|
| CN | 205223658 | U | 5/2016 |
| CN | 205368780 | U | 7/2016 |
| CN | 106032637 | A | 10/2016 |
| EP | 1654411 | B1 | 5/2006 |

* cited by examiner

APPLIANCE DOOR ASSEMBLY

CROSS-REFERENCE TO RELATED APPLICATIONS

This application is a continuation application of U.S. patent application Ser. No. 15/350,683, filed Nov. 14, 2016, now U.S. Pat. No. 10,294,712, issued on May 21, 2019, which is incorporated herein by reference in its entirety.

BACKGROUND

A household appliance commonly has a cabinet defining an interior that is accessible through a door. Electronic devices, such as a user interface, can be partially or fully integrated into the door and supplied power or data from the cabinet. A wire harness typically passes from the cabinet to the door at a convenient location such as through the hinge knuckle or pin of a hinge connecting the door to the cabinet. The wire harness is subject to fatigue as the door is opened/closed, which can pull, move, twist, etc. the wire harness during each opening/closing.

BRIEF SUMMARY

One aspect of the invention relates to an appliance door assembly comprising: a first door frame; a second door frame; a hinge having a first hinge plate mounted to the first door frame, and a second hinge plate mounted to the second door frame, wherein the first hinge plate is rotatable relative to the second hinge plate about a hinge rotational axis; and a wire cover that is rotatable about the hinge rotational axis and having first and second halves defining a wire channel through which an electrical conductor can pass between the first and second door frames.

DETAILED DESCRIPTION

Systems, components, and methodologies in accordance with the present disclosure enable a manufacturer of a laundry treating appliance to assemble the laundry treating appliance with greater ease and efficiency. Modern laundry treating appliances sometimes have electronic systems built into their doors, such as user interface systems. In certain implementations, the door is electrically connected to the cabinet of the laundry treating appliance. This may require a manufacturer to mount the door to the cabinet while also forming an electrical connection between the door and the cabinet. In some exemplary assembly procedures, one assembler holds the door in a mounting position while another assembler forms the electrical connection—this procedure is inefficient because it requires two individuals. In other cases, one individual both holds the door in a mounting position and makes the connection. This is cumbersome.

Systems, components, and methodologies in accordance with the present disclosure provide a wire cover that provides a convenient way to form electrical connections after the door is securely mounted to the cabinet. This is a great benefit to the assembler of the appliance as the weight associated with all portions of the door is carried by the cabinet and the assembler need not hold any portion of the door when making the connection.

Figure 1:
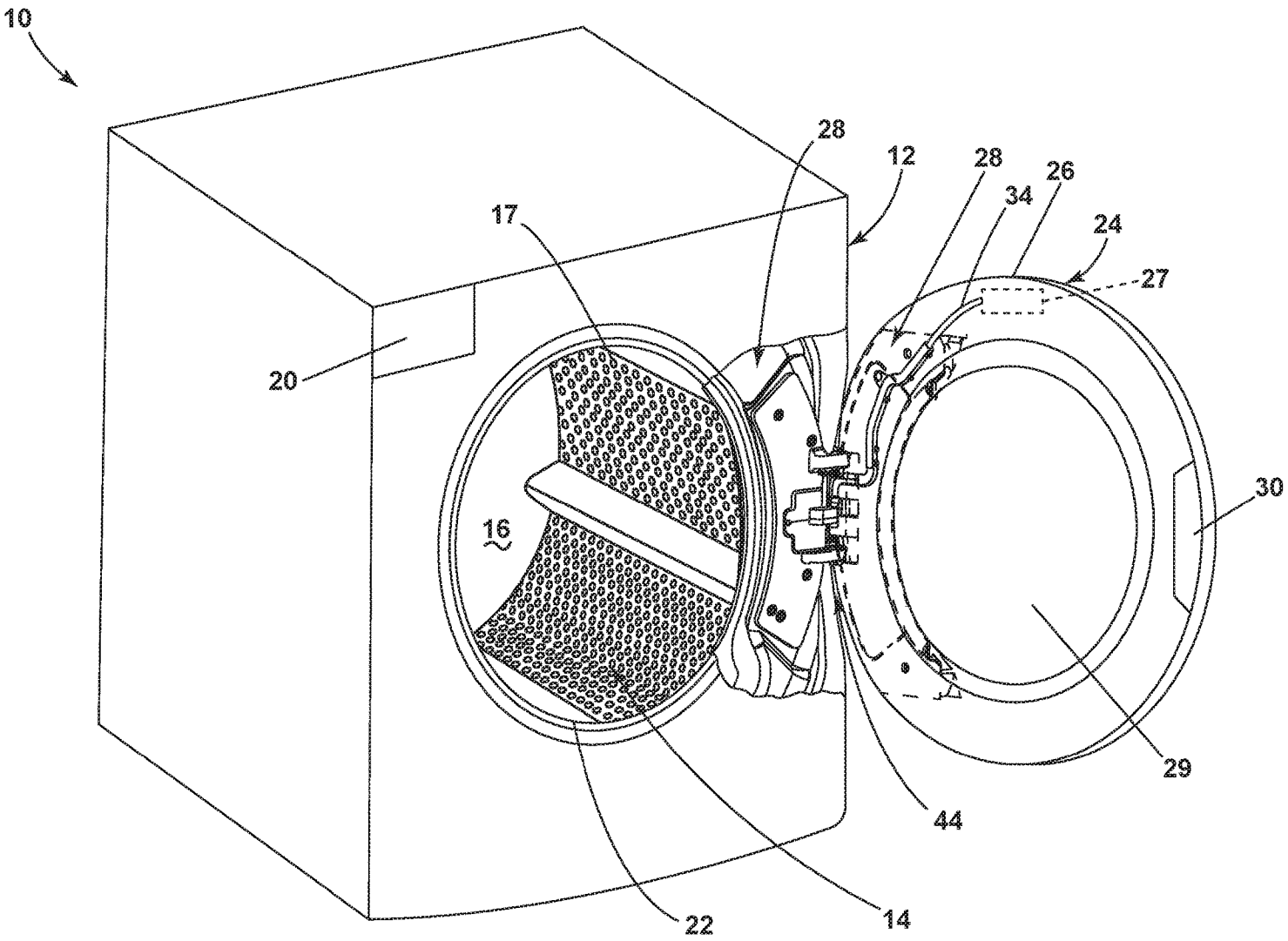
FIG. 1 is a perspective view of a horizontal axis laundry treating appliance incorporating aspects of the invention, with a door assembly of the laundry treating appliance showing a door in an opened position, and a wire harness having conductors passing between the cabinet and the door, with a protective wire cover.

FIG. 1 shows a perspective view of an exemplary laundry treating appliance in accordance with the present disclosure in the environment of a horizontal axis automatic clothes washing machine 10. Although much of the remainder of this application will focus on the embodiment of an automatic clothes washing machine, the present disclosure may have utility in other environments, including other laundry treating appliances, such as dryers or refreshers. The embodiments also have applicability in any configuration such as for both horizontal and vertical axis laundry treating appliances, regardless of whether they are top or front loading. Depending on the configuration, it is possible for the embodiments to have applicability in vertical axis washing machines and other appliances, refrigerators, microwaves, dishwashers, etc., having a hinged door designed to incorporate a wiring harness for electrical wirings to pass through. Embodiments can also have applicability outside of the home appliance market. Embodiments can have applicability in any implementation where wires are passed into a door.

The washing machine 10 shares many features of a conventional automated clothes washer and dryer, which will not be described in detail herein except as necessary for a complete understanding of the illustrative embodiments in accordance with the present disclosure. The laundry treating appliance of FIG. 1 is illustrated as a horizontal axis washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub (not shown) located within the interior of the cabinet 12 and defines a liquid-holding chamber in which liquid for the treating cycle is held during operation, and a drum 14 located within the tub and which can be rotatably mounted to the tub or the cabinet 12. A suspension system (not shown) suspends at least one of the tub and drum 14 relative to the cabinet 12.

The drum 14 defines a treating chamber 16 for receiving the laundry and rotates about a generally horizontal axis.

The drum 14 can include a plurality of perforations 17 such that liquid can flow between the tub and the drum 14 through the perforations. The drum 14 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket.

The washing machine 10 can also be provided with a dispenser 20 for dispensing treating chemistry to the treating chamber 16 for use in treating the laundry according to a cycle of operation. Non-limiting examples of treating chemistries that can be dispensed by the dispenser 20 during a cycle of operation include one or more of the following: water, detergents, softeners, bleach, rinse aids, surfactants, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry holding system may further include a door assembly 24 including a door 26 that selectively opens/closes the opening 22 to the treating chamber 16. The door assembly 24 comprises first and second door frame elements 28 connected by a hinge 44. One of the door frame elements 28 mounts to the cabinet 12 and the other mounts to the door 26, with the hinge 44 connecting the door frame elements 28. The door frame element 28 associated with the door 26 defines a transparent window 29 to allow the user to see the inside of the treating chamber 16 through the door 26. The door 26 has a handle 30 for grasping the door 26 by a user and pivotally opening/closing the door about a hinge 44. The door 26 can be equipped with integrated electronic device 27 which requires electrical connection to pass through the hinge 44. The electronic device includes but is not limited to a user interface controller, a touch screen, a liquid crystal display, a proximity sensor or a Wi-Fi receiver.

Figure 2:
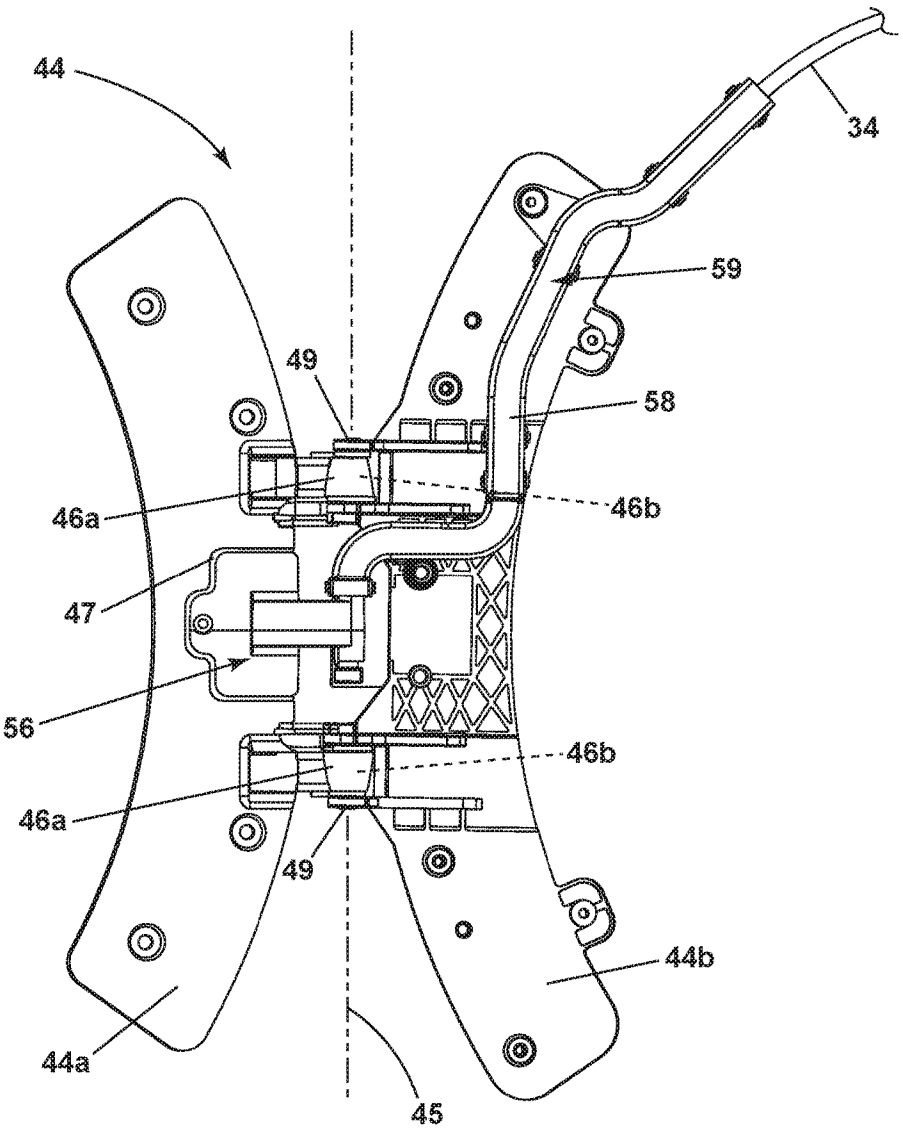
FIG. 2 is a front view of the door assembly of FIG. 1, with the door removed for clarity to show the hinge, wire harness, wire cover, and wire conduit with the hinge in the opened positioned.

Referring to FIG. 2, the hinge 44 comprises two hinge plates 44*a*, 44*b* pivotable relative to each other about a hinge rotational axis 45. The first hinge plate 44*a* has a first set of hinge knuckles 46*a* and mounted to the cabinet 12 via one of the door frame elements 28. The first hinge plate 44*a* includes a slot 47 to allow a conductor, such as a wire harness for the cabinet, to pass through from the cabinet 12. The second hinge plate 44*b* has a second set of knuckles 46*b* is mounted to the door 26 via the other one of the door frame elements 28. A set of hinge pins 49 rotationally couples the first and second sets of knuckles 46*a*, 46*b* to define the hinge rotational axis 45.

A wiring conduit 58 is mounted to the second hinge plate 44*b* and provides an interior passage 59 through which a conductor may pass, such as the conductor(s) of a wiring harness. While the wiring conduit 58 is mounted to the second hinge plate 44*b*, it is also at least partially received within the door 26.

A wire cover 56 is carried by the door assembly 24 such that a portion of the wire cover 56 is rotatably mounted to the wiring conduit 58 and rotates along an axis that is aligned with the rotational axis 45. In such a mounting, the wire cover 56 is rotatable between first and second positions, with the second position being illustrated in FIG. 2. In the first position, the wire cover 56 is rotated more toward the second hinge plate 44*b* to expose a backside of the wire cover 56. In the second position, the wire cover 56 is rotated more toward the first hinge plate 44*a* to hide the backside of the wire cover 56.

Figure 3:
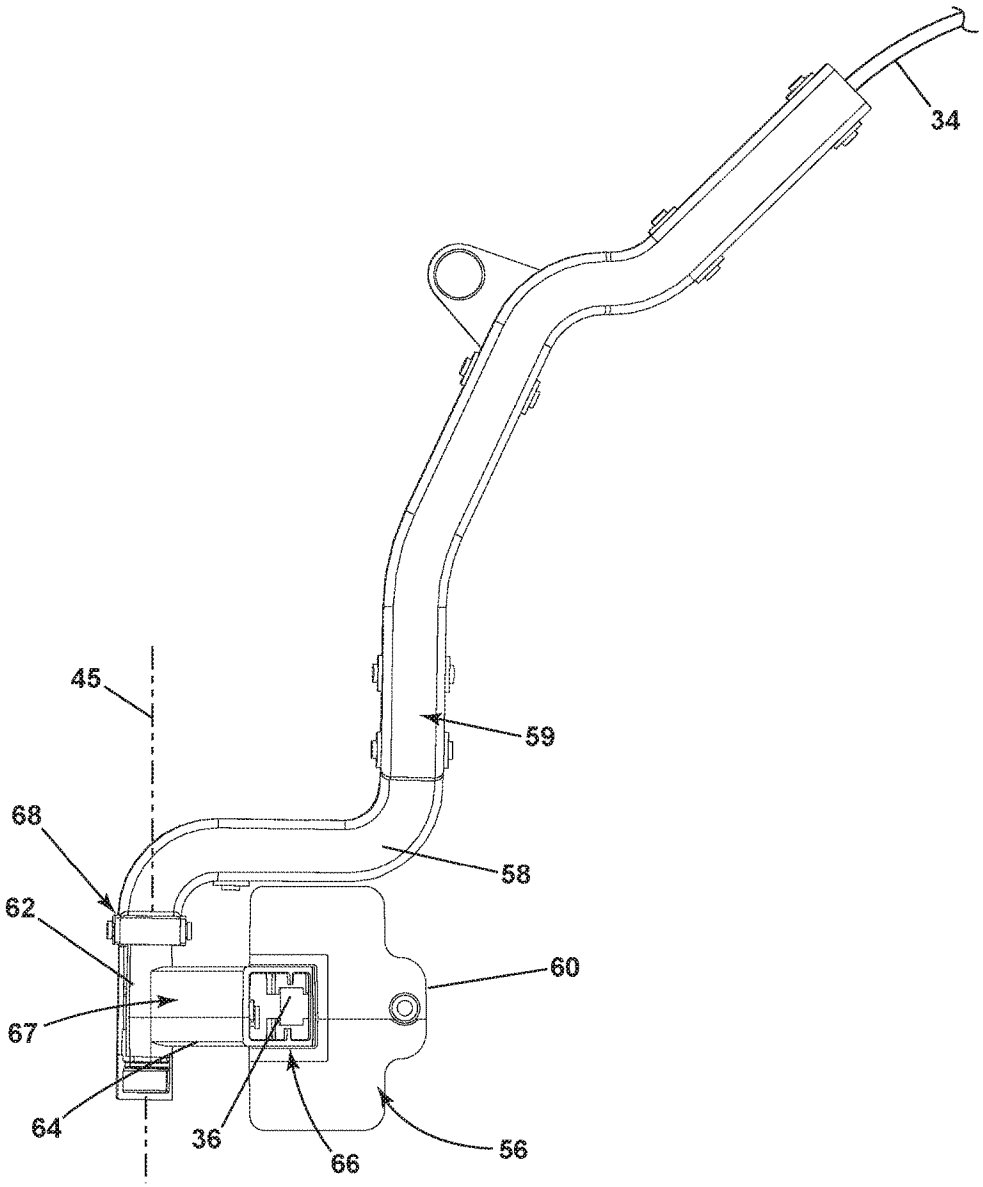
FIG. 3 is a rear view of the wire harness showing the wire cover in a first position.

As shown in FIG. 3, the wire cover 56 comprises a mounting plate 60 and conduit mount 62, which are connected by arm 64. A connector seat 66 is provided on the mounting plate 60. The conduit mount 62, arm 64 and connector seat 66 define an internal passage 67 through which a portion of the conductor 34, such as from a wiring harness in the door 26, is received and a connector 36 on the end of the conductor 34 can be fixed within the connector seat 66.

Figure 4A:
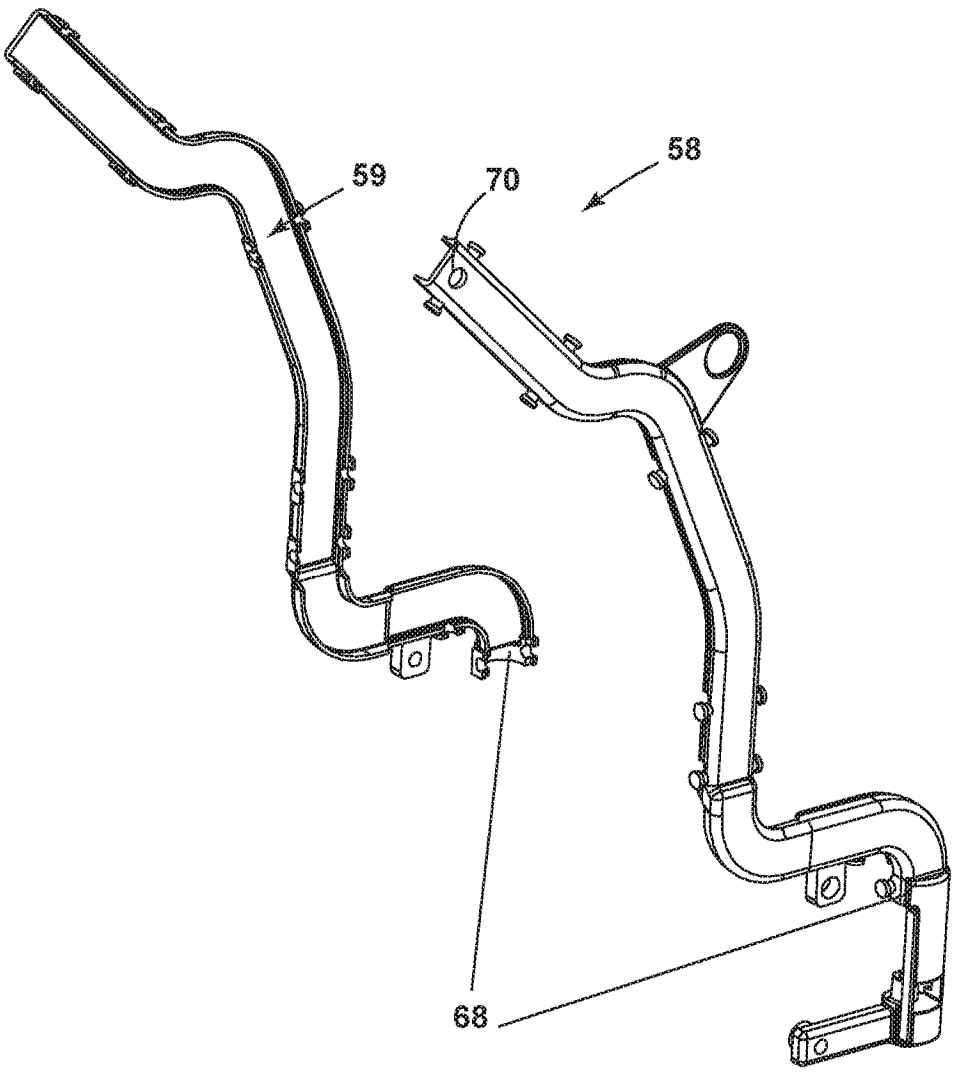
FIG. 4A is an exploded view of the wire conduit of FIG. 3.

The wire cover 56 and wiring conduit 58 are rotatably coupled together. While the rotational coupling can take any suitable form, as illustrated, the wiring conduit 58 encompasses the conduit mount 62 to form a rotary coupling 68. More specifically, a lower end of the wiring conduit 58 coaxially receives an end of the conduit mount 62 to form the rotary coupling 68. As illustrated in FIG. 4A, the wiring conduit 58 can be formed of two halves, which are snapped around the conduit mount 62 to form the rotary coupling 68. In this way, the passageway 59 of the wiring conduit 58 is coaxial with the passageway 67 of the conduit mount 62.

A strain relief 70 in the form of a small aperture is provided near the top of the wire conduit 58 to allow a zip-tie to run through the aperture and secure the conductor 34 in place. By securing the conductor 34 to the strain relief aperture 70, the lower portion of the conductor 34 can move freely between the strain relief 70 and the connector seat 66 without any tugging of the connector 36 when it is seated within the connector seat 66.

Figure 4B:
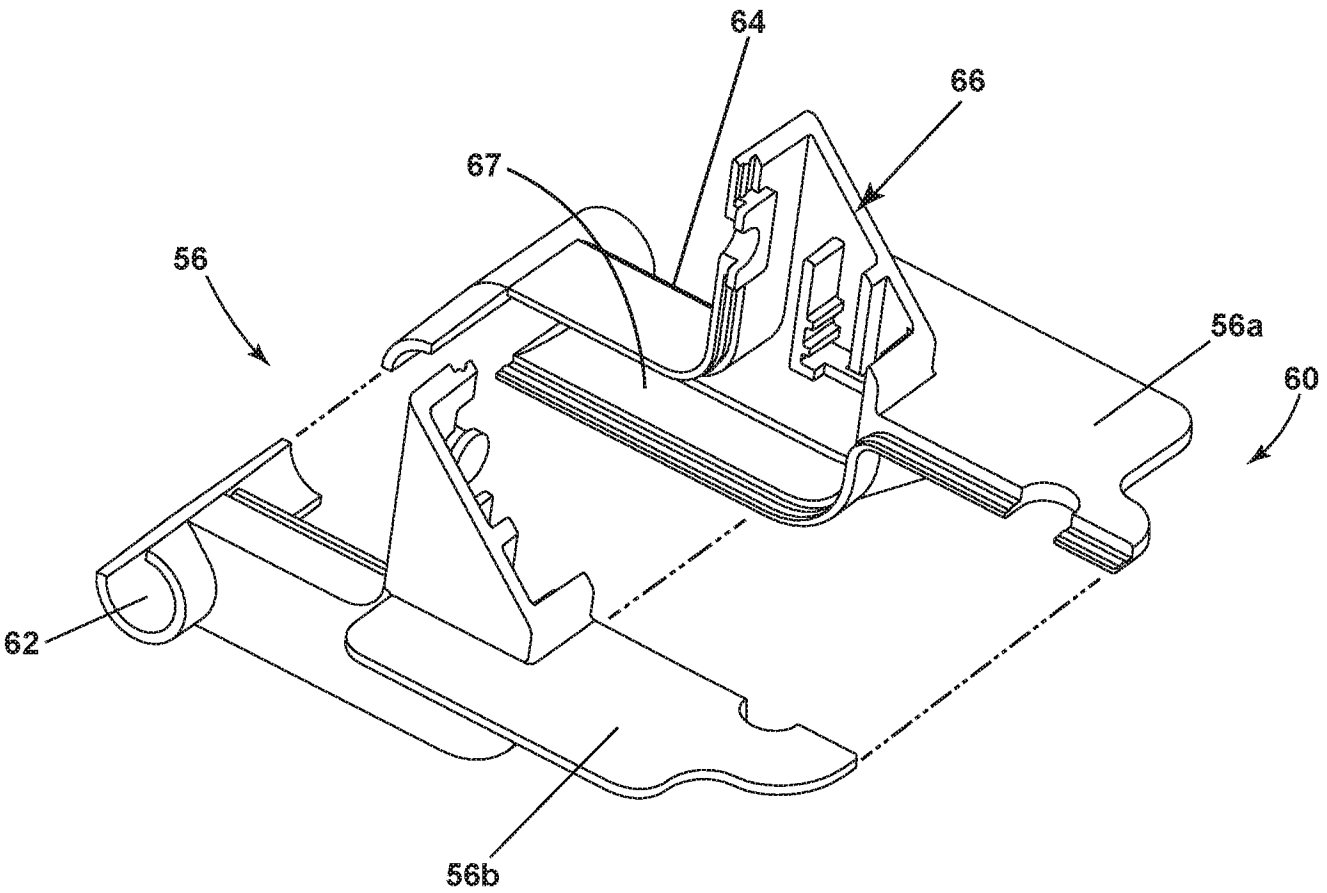
FIG. 4B is an exploded view of the wire cover of FIG. 3.

Referring to FIG. 4B, the wire cover 56 comprises first 56*a* and second 56*b* lateral halves, which utilizes a snap-fit mechanism to couple the first 56*a* and second 56*b* lateral halves to releasably secure them together. When secured together, the wire cover 56 forms the wire passageway 67 through the arm 64 to the interior of the conduit mount 62 and the connector seat 66. The conduit mount 62 is split into lateral halves along the length of the tube in such a way that a wire can be encased within the tube without running the end of the wire through the tube openings.

Figure 5:
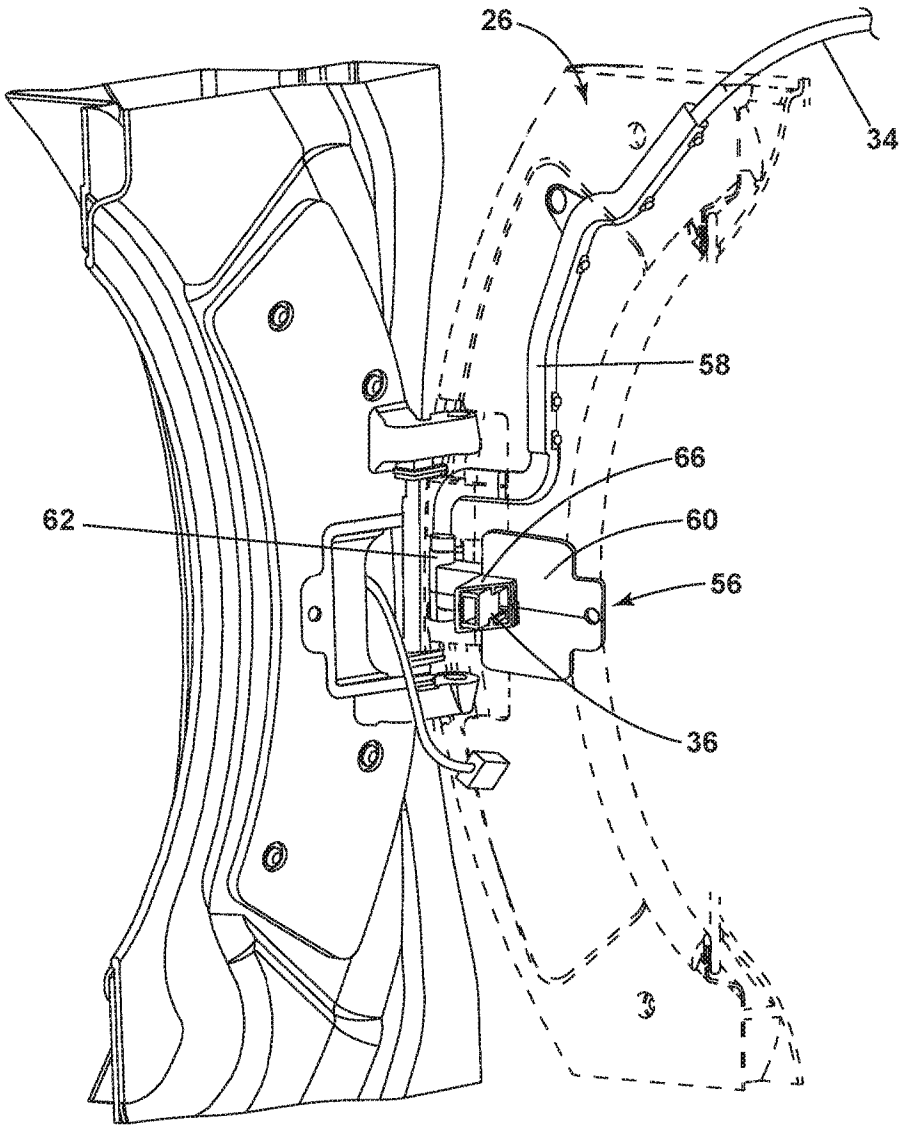
FIG. 5 is a perspective view illustrating the installation of the wire cover to the wire harness, with the wire cover in a first position and holding a first connector from the door, with a second connector from cabinet being free.

The method of assembling the wire cover 56 will be described with reference to FIGS. 5-7. The method of assembly is begun with the wire conduit 58 mounted to the door 26, the wire cover 56 rotatably mounted to the wire conduit 58, and the conductor 34 in the door 26 and the corresponding connector 36 already placed within the connector seat 66 as is shown in FIG. 4B. In this position, the mounting plate 60 is free to rotate relative to the wire conduit 58 and independently of the rotation of the door 26.

Figure 6:
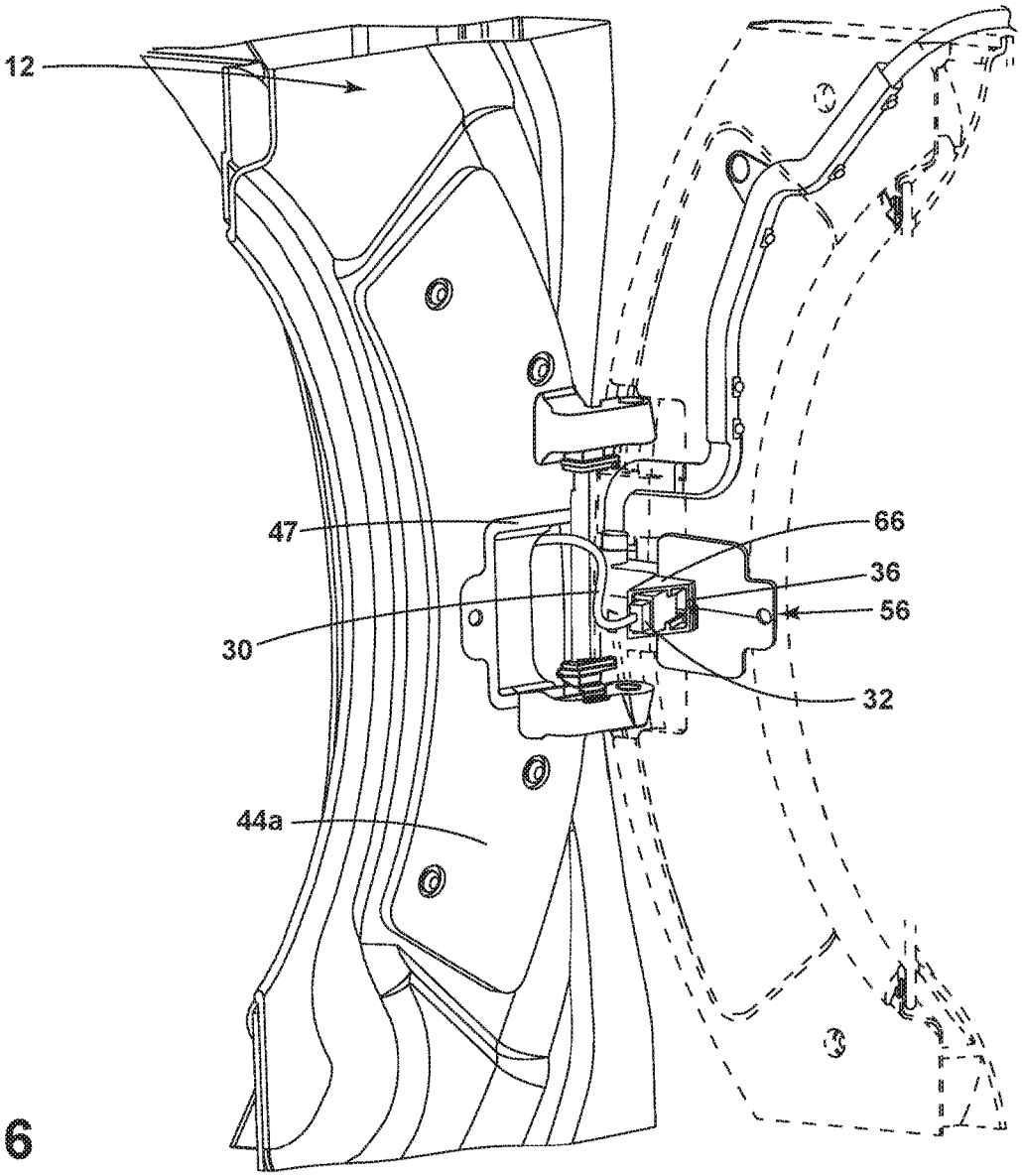
FIG. 6 is a perspective view illustrating the wire cover in the first position, with the first and second connectors coupled together.
Figure 7:
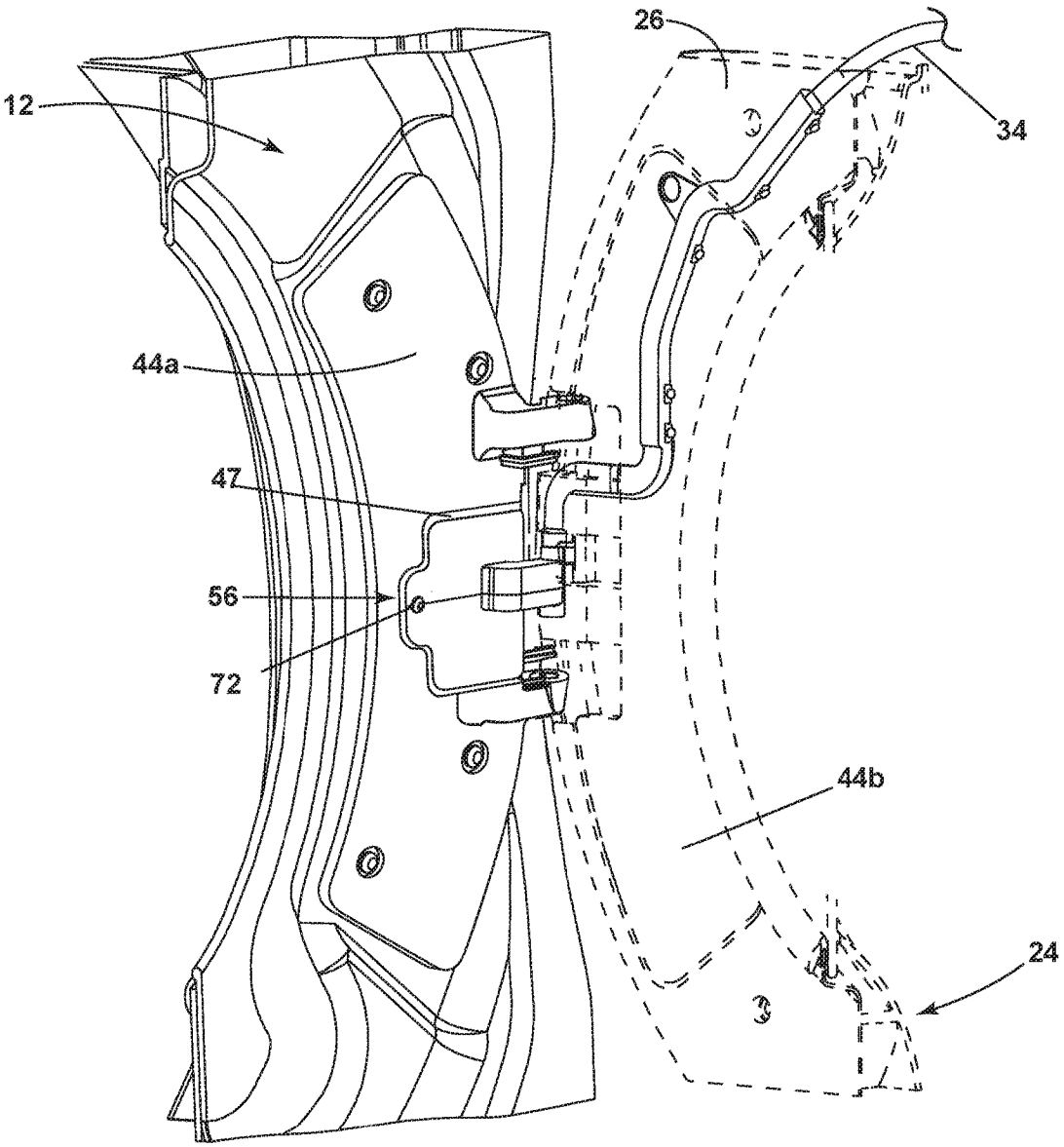
FIG. 7 is a perspective view illustrating the wire cover in a second position covering the conductors of the wire harness.

As shown in FIG. 6, the wire cover 56 is rotated to a first position away from the first hinge plate 44*a* to expose the slot 47 through which another connector 32 for the conductor 30 in the cabinet 12 can be pulled from or already extends from the cabinet 12. The connector 32 can then be connected to connector 36 residing in the connector seat 66. Referring to FIG. 7, after the connection is made, the wire cover 56 is rotated to a second position away from the second hinge plate 44*b* to hide the connected connectors 32, 36 between the cover 56 and the slot 47. The connectors can be received within the slot 47 as part of the movement of the wire cover 56 to the second position. In this position, the wire cover 56 overlies the slot 47. One or more fasteners 72 can be used to secure the cover 56 to the first hinge plate 44*a*.

The wire cover 56 provides for a convenient way to connect the connectors 32, 36 associated with the conductors 30, 34 in the cabinet 12, door 26, respectively, after the door 26 is mounted to the cabinet 12. This is a great benefit to the assembler of the appliance as the weight associated with all portions of the door assembly 24 or door 26 is carried by the cabinet 12 and the assembler need not hold any portion of the door assembly 24 or door 26 when making the connection. If the assembler needed to hold the door assembly 24 or door 26 while making the connection, then the assembly could require two individuals—one to hold the door and one to make the connection. Alternatively, if an assembler was working alone, the assembler would need to hold the door assembly 24 or door 26 while making the connection, which would be cumbersome. In the systems and methodologies disclosed herein, the assembler can mount the door 26 to the cabinet 12 prior to making the connection. Then, the assembler need only connect the connectors 32, 36, rotate the cover 56 adjacent the first hinge plate 44*a*, and secure the cover 56 to the first hinge plate 44*a* with fasteners.

The conductors in the cabinet 12 and door 26 are typically wiring harnesses located in each of the cabinet 12 and door 26, which are installed during the assembly of the cabinet 12 and door 26. The cover 56 simplifies the connecting of these wire harnesses.

The wire cover 56 protects the wire conductor 34 that passes through the hinge rotational axis 45 where it has a tendency to get pulled and damaged when the door 26 is in motion. The coaxial rotary coupling 68 also controls the rotation of the conductor to be at a desired location where the degree of twisting of the conductor associated with the opening/closing of the door 26 can be controlled. Further, the wire cover 56 with lateral halves 56*a*, 56*b* is designed for ease of installation during the assembly process where it can simply be snapped together to encase the wire conductors 34. Without the need to dismount or disassemble the door 26 to install the wire cover 56, assembly or maintenance process can be done by a single technician.

Although the embodiment of the present invention have been shown and described, it would be appreciated by those skilled in the art that changes may be made in these embodiments without departing from the principles and spirit of the invention, the scope of which is defined in the claims and their equivalents.

The invention claimed is:

1. An appliance door assembly, comprising:

a first door frame;

a second door frame;

a hinge having a first hinge plate mounted to the first door frame, and a second hinge plate mounted to the second door frame, wherein the first hinge plate is rotatable relative to the second hinge plate about a hinge rotational axis; and a wire cover that is rotatable about the hinge rotational axis and having a first half and a second half defining a wire channel through which an electrical conductor can pass between the first door frame and the second door frame, the wire cover forming a L-shaped configuration with a first leg and a second leg.

2. The appliance door assembly of claim 1 wherein at least one of the first leg or the second legs forms the wire channel.

3. The appliance door assembly of claim 2 wherein an other of the first leg or the second legs rotates about the hinge rotational axis.

4. The appliance door assembly of claim 3 wherein the hinge further comprises a hinge pin rotatably coupling the first hinge plate and the second hinge plates, with the hinge pin defining the rotational axis, and the other of the first leg or the second legs rotates about the hinge pin.

5. The appliance door assembly of claim 1, further comprising a wiring conduit located within the second door frame.

6. The appliance door assembly of claim 5, further comprising a rotary coupling rotatably connecting the wiring conduit to the wire cover.

7. An appliance door assembly, comprising:

a first door frame;

a second door frame;

a hinge having a first hinge plate mounted to the first door frame, and a second hinge plate mounted to the second door frame, wherein the first hinge plate is rotatable relative to the second hinge plate about a hinge rotational axis; and a wire cover that is rotatable about the hinge rotational axis and having a first half and a second half defining a wire channel through which an electrical conductor can pass between the first door frame and the second door frame and at least one of the first half or the second half has a connector seat.

8. The appliance door assembly of claim 7 wherein, in a partially assembled configuration, the wire cover is rotatable relative to one of the first door frame or the second door frames to expose the connector seat relative to the one of the first door frame or the second door frames.

9. The appliance door assembly of claim 8 wherein, in the partially assembled configuration, the wire cover is secured to an other of the first door frame or the second door frames by a fastener securing the wire cover to one of the first door frame or the first hinge plate.

10. The appliance door assembly of claim 7 wherein the first half and the second half comprise a first lateral half and a second lateral half that are releasably secured together.

11. The appliance door assembly of claim 10, further comprising a snap fit coupling the first lateral half and the second lateral half to releasably secure them together.

12. The appliance door assembly of claim 7, further comprising a first electrical conductor having a first connector associated with the first door frame and a second electrical conductor having a second connector associated with the second door frame.

13. The appliance door assembly of claim 12 wherein the first connector extends through an opening in one of the first door frame or the first hinge plate.

14. The appliance door assembly of claim 12 wherein the first electrical conductor and the second electrical conductors conduct at least one of electrical power or data.

15. The appliance door assembly of claim 14, further comprising a user interface provided with one of the first door frame or the second door frames and connected to another end of the corresponding first electrical conductor or the second electrical conductor.

16. The appliance door assembly of claim 15 wherein an other of the first door frame or the second door frames defines a window.

17. The appliance door assembly of claim 7 wherein at least one of the first door frame or the second door frames defines an access opening.

18. An appliance door assembly, comprising:

a first door frame;

a second door frame;

a hinge having a first hinge plate mounted to the first door frame, and a second hinge plate mounted to the second door frame, wherein the first hinge plate is rotatable relative to the second hinge plate about a hinge rotational axis;

a wire cover that is rotatable about the hinge rotational axis and having a first half and a second half defining a wire channel through which an electrical conductor can pass between the first door frame and the second door frame; and at least one of:

a wiring conduit located within the second door frame and a rotary coupling rotatably connecting the wiring conduit to the wire cover; or a first electrical conductor having a first connector associated with the first door frame and a second electrical conductor having a second connector associated with the second door frame wherein the first connector extends through an opening in one of the first door frame or the first hinge plate.

19. The appliance door assembly of claim 18 wherein the wiring conduit receives a portion of the wire cover to form the rotary coupling.

20. The appliance door assembly of claim 18 wherein the wire cover overlies the opening in an assembled configuration.

* * * * *